US006161960A

United States Patent [19]

Hiraoka et al.

[11] Patent Number: 6,161,960

[45] Date of Patent: Dec. 19, 2000

[54] CONTAINER

[75] Inventors: Takayuki Hiraoka; Tsuyoshi Hamawaki, both of Kasuya; Tatsuya Ide, Ohtake, all of Japan

[73] Assignee: Kyushu Taiyoukasie LTD, Fukuoka, Japan

[21] Appl. No.: 09/269,788

[22] PCT Filed: Aug. 27, 1998

[86] PCT No.: PCT/JP98/03804

§ 371 Date: Apr. 1, 1999

§ 102(e) Date: Apr. 1, 1999

[87] PCT Pub. No.: WO99/11533

PCT Pub. Date: Mar. 11, 1999

[30] Foreign Application Priority Data

Sep. 4, 1997 [JP] Japan ..... 9-239718

[51] Int. Cl.[7] ..... B65D 33/01

[52] U.S. Cl. ..... 383/103; 383/107

[58] Field of Search ..... 383/44, 45, 46, 383/47, 48, 51, 57, 58, 41, 100, 101, 103, 107, 903, 904, 906, 3

[56] References Cited

U.S. PATENT DOCUMENTS

| | | | |
|---|---|---|---|
| 2,950,037 | 8/1960 | Orsini | 383/44 X |
| 5,558,137 | 9/1996 | Futerman | 383/100 X |

FOREIGN PATENT DOCUMENTS

| | | | |
|---|---|---|---|
| 204022 | 12/1954 | Australia | 383/44 |
| 649769 | 12/1962 | Italy | 383/44 |
| 60-47232 | 4/1985 | Japan . | |
| 4327165 | 12/1994 | Japan . | |
| 78235 | 2/1995 | Japan . | |
| 330696 | 7/1958 | Switzerland | 383/44 |
| 407725 | 9/1966 | Switzerland | 383/44 |

*Primary Examiner*—Jes F. Pascua

[57] ABSTRACT

A container for use in bulk transporting chemical goods, grains and the like, comprises a sack body in the form of a rectangular parallelepiped prepared from a cylindrical blown film. The container has a feeding end, a discharging end and a ventilating end. Enhanced pressure-resistive strength is obtained by improving the ventilating end-mounted design so as to have a specific shape. In one embodiment, a line slit is formed through the sack body, a cylindrical film is inserted into the slit, and the sack body and the cylindrical film are bonded to each other in line along the periphery of the slit so that the bonded corner spots, of the sack body and the cylindrical film, located at both ends of the slit, has a shape of a convex curve, for example, a circular shape or a ringed shape. This bonded structure makes it possible to deconcentrate pressure applied in using and filling the container without concentrating on the corner spot to prevent generation of pinholes and sack burst of the container.

9 Claims, 6 Drawing Sheets

PRIOR ART

PRIOR ART

CONTAINER

CROSS REFERENCE TO RELATED APPLICATION

This application is the national phase application of International Application PCT/JP98/03804, filed Aug. 27, 1998.

FIELD OF THE INVENTION

The present invention relates to a plastic container for bulk transportation for use in safekeeping and transporting chemical goods, plastics, grains, fertilizers and the like, more especially to an improved container having a specific ventilator-mounted design.

BACKGROUND OF THE INVENTION

Bulk transportation of chemical goods, plastics, grains, fertilizers and the like is practiced on a large scale now as a part of streamlining physical distribution ways and means, and a large plastic container is used for one of the transportation means. For example, a sack in the form of a rectangular parallelepiped of 6 to 12 m in length made of a cylindrical plastic film prepared by blown-film extrusion is actually used for transporting products stored therein.

Taking an example of this form by FIG. 1 showing a perspective view of a container, a container 1 is, as a whole, made of a sack body in the form of a rectangular parallelepiped prepared by cutting a cylindrical inflation film into the required length, folding both ends of the film longitudinally and bonding the superposed portion of the both ends. This large container 1 is used for bulk transportation of, e.g., solid terephthalic acid. Terephthalic acid is introduced into the container through a feeding end 3 by applying air pressure from outside. Terephthalic acid is taken out from a discharging end 4 to the outside. The facilitate filling and discharge the container has a ventilating end 5 as an air passage.

Up to this time, this ventilating end has been mounted on the container by making a short line slit through a sack body as for a body of a container, inserting a cylindrical film for a ventilating end into the slit and bonding both of them by heat-sealing.

Now, a process for mounting a ventilating end on a sack body will be explained in more in detail with reference to FIGS. 10 and 11. FIG. 10 is a perspective view showing the state of a ventilating end 100 mounted on a sack body 102, and FIG. 11 shows its cross-sectional view. At first, as shown in FIG. 10, a sack body 102 is prepared by folding both ends of a film 101 and bonding the superposed portion 103 of the folded ends by heat-sealing. At this time, by inserting a cylindrical film 104 into the superposed portion 103 and heat-sealing along the superposed portion 103, production of the sack body and mounting of the ventilating end can be attained in one process. During this time, as shown in FIG. 11, by inserting a fluorocarbon resin sheet 105 inside the cylindrical film 104, bonding both insides of the cylindrical film 104 to each other during heat-sealing can be avoided.

In this production process, a cone summit, or an acute summit is structurally formed in both corners of the heat-sealed portion 106 of the sack body 102 and the cylindrical film 104. On condition that the summit of the both corners is cone-shaped, stress due to air pressure in storing or discharging fillings concentrates on this spot to induce the generation of pinholes which start from the summit spot and extend along the heat-sealed portion 106. To this end, it has been hitherto taken such measures as to prevent lowering of pressure produced by pinholes, easy which are easily developed in the vicinity of the heat-sealed portion 106 and bursting of the container with locally applied large stress, by applying a pressure-sensitive tape 107 for reinforcing closely to (in the vicinity of) the heat-sealed portion 106.

However, these measures require much time taken in operation to result in a raise of cost, and to enhance the adhesive strength of the heat-sealed portion still more is also needed.

DISCLOSURE OF THE INVENTION

Now, object of the invention is to enhance the pressure-resistive strength of a container by improving the ventilating end-mounted design of a container. A second object of the present invention is to provide a container in the form of a sack from which generation of pinholes may be prevented without using a pressure-sensitive tape for reinforcing and bursting of a sack of a container may be prevented even when large stress is applied. These and other objects and advantages of the invention may be readily ascertained by referring to the following description and appended drawings.

Accordingly, the present invention provide to a container of a sack body made of plastic film through which a slit is made and a cylindrical film is inserted therethrough, the sack body and the cylindrical film being bonded to each other and united along the periphery of the slit, both of the bonded portions, of the sack body's periphery and the cylindrical film located around both ends of the slit along the longitudinal direction, having a convex curve projecting toward the inside of the sack body. That both of the bonded portions have a circular or ringed shape is especially preferable for enhancing pressure-resistive strength of the container.

In this container, since the corner spot where the sack body and the cylindrical film are bonded has a shape of convex curve projecting toward the inside of the sack body, the pressure or stress applied to the inside of the sack body may be made deconcentrated without concentrating on the corner of the bonded portion. Accordingly, generation of pinholes can be suppressed, pressure-resistive strength of the container may be enhanced, and consequently, burst of the container may be prevented.

The present invention also provide to a container in which a reinforcing film is bonded on the aforementioned bonded portion in the same shape with that of the bonded portion. By this reinforcing film, pressure can be deconcentrated as a matter of course, undercut from the bonded portion will be saved to prevent second cut, i.e. the bonded portion will be kept the balance of thickness, and consequently, strength of the bonded portion may be increased still more.

The present invention further provide to a container of a sack body approximately in the form of a rectangular parallelepiped, having at one side portion of the sack body a feeding end for storing fillings into the sack body by pressure, a discharging end for discharging the fillings out of the sack body and a ventilating end made of a cylindrical film which is inserted into a slit made through the sack body, the sack body and the cylindrical film being bonded to each other and united, both of the bonded portions, of the sack body's periphery and the cylindrical film located around opposite ends of the slit along the longitudinal direction, having a convex curve projecting toward the inside of the sack body. This container has high pressure-resistive strength.

THE BEST MODE FOR WORKING OF THE INVENTION

The constitution of a container according to the present invention will be described in further detail by way of example with reference to the accompanying drawings.

Figure 1:
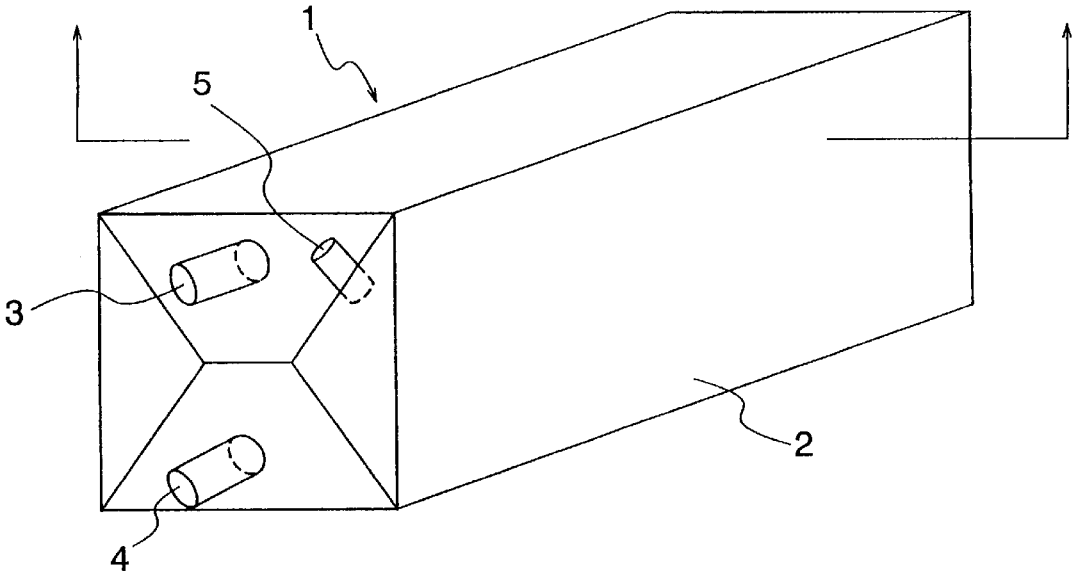
FIG. 1 is a perspective view showing a complete container.
Figure 2:
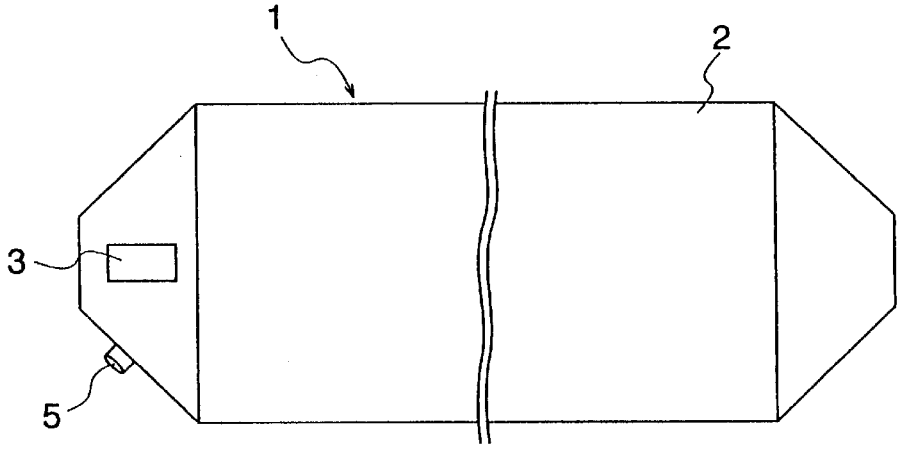
FIG. 2 is its top view.

A container of the present invention is shown completely in a perspective view of FIG. 1, and its top view is shown in FIG. 2. A container 1 for use in bulk transportation is of a sack body 2, which is approximately in the form of a rectangular parallelepiped, and, on one end portion of longitudinal direction, has a feeding end or feeding passage 3 for use in feeding fillings by pressure from outside, a discharging end or discharge passage for use in discharging fillings out of the sack body, and further, a ventilating end or ventilator 5 required in storing fillings through the feeding end 3 or discharging fillings through the discharging end 4 by air pressure.

Materials of the container should not be limited, but a thermoplastic film or sheet is often used. For example, there can be used plastic film including polyethylene such as low-density polyethylene (LDPE), linear low-density polyethylene (LLDPE), ethylene-vinyl acetate copolymer (EVA.), polypropylene, nylon, polyethylene terephthalate (PET) or the like, or otherwise, laminated film of these plastic film with other thermoplastic film Appropriate material is selected depending on the property of substances to be filled into the container, filling conditions and the like, and heat-resistant material is selected for high-temperature feeding; and gas barrier material is selected for filling substances moisturized or oxidized. The film thickness may be 50 to 400 $\mu$m, preferably 100 to 300 $\mu$m. When the film thickness is in this range, film is called "film" or "sheet" in general, but called "film" hereinafter in this specification.

Figure 3:
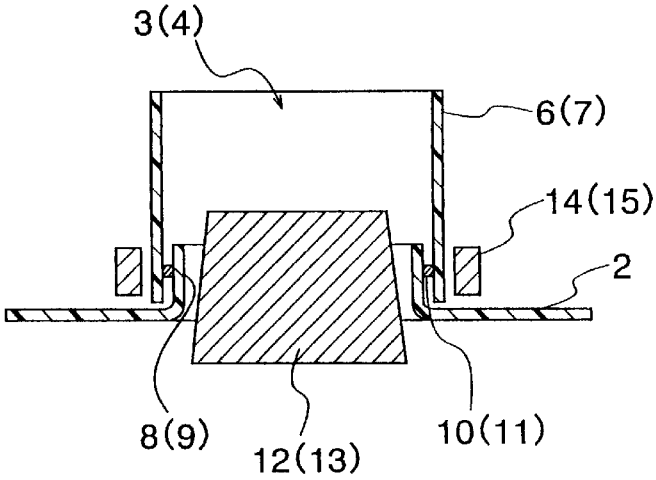
FIG. 3 is a cross-sectional view for explaining an embodiment of mounting a feeding end and a discharging end.

The above feeding end 3 and discharging end 4 are mounted on the sack body 2 in the same mounting process as suggested in FIG. 3. In this process, approximately circular openings 8 and 9 are made through the positions of the sack body 2 on which the feeding end 3 or the discharging end 4 is to be mounted. Secondary, in such manner as to arrange outside cylindrical films, for finally providing feeding end 3 and discharging end 4, i.e., cylindrical bodies 6 and 7, the opening 8 (9) of the sack body 2 is covered with the cylindrical body 6 (7) which is then superposed on the periphery of the opening 8 (9). Thereafter, an adhesive material 10 (11) is interposed between the cylindrical body 6 (7) and the opening 8 (9) of the sack body 2, while a setting 12 (13) is put into the cylindrical body 6 (7). Then, the adhesive material 10 (11) is molten by heating and pressing with heat sealer 14 (15) from outside. Consequently, the cylindrical body 6 (7) is bonded to the sack body 2 along the periphery of the opening 8 (9), thereby the feeding end 3 and discharging end 4 are mounted on the sack body 2 in one piece. Here, when sack body and cylindrical body are made of melt-adhesive materials which make it possible to bond these bodies to each other, the adhesive material 10 (11), of course, may be eliminated.

Figure 4:
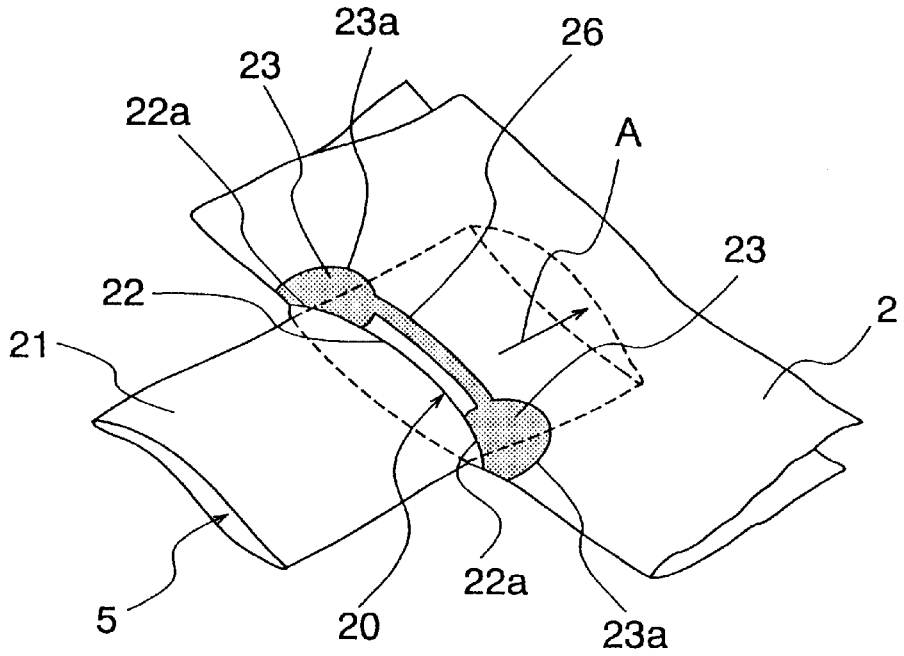
FIG. 4 is a perspective view of an essential part of a container belonging to one embodiment of the present invention.

For mounting ventilating end 5 on the sack body 2, which is one of the improvement by the present invention, a different design from the design for mounting the feeding end 3 and the discharging end 4 on the sack body 2 is applied. FIG. 4 is a perspective view which suggests one example of the following mounting design. Namely, through a sack body 2 made of plastic film , which is previously gusseted from diameter direction of blown film toward center thereof, a slit 20 is made in line. Into the slit 20 a cylindrical film 21 for a ventilating end 5 is inserted, the sack body 2 and the cylindrical film 21 are bonded to each other on the periphery 22 of the slit 20 to form a bonded portion 23. Then, the corner spot 23*a*, in the bonded portion 23, formed by bonding the periphery 22*a* positioned at each end of slit 20 along its longitudinal direction and the cylindrical film 21, is formed to have a shape of convex curve projecting toward the inside of the sack body 2, i.e., the direction of arrow line A as shown in FIG. 4. In other words, the corner spot 23*a* should have a shape of convex curve without forming an acute summit toward the inside of the sack body 2. As for the materials of the sack body 2 and the cylindrical film 21, preferable are those easy to melt and bond to each other, and especially, thermoplastic films of the same material are appropriately used because of having their high adhesive strength. Of course, an adhesive layer may be formed between the sack body 2 and the cylindrical film 21 to enhance their adhesive strength.

It is important for both of the corner spots 23*a* in the bonded portion 23 of the sack body 2 and the cylindrical film 21 to have a shape curved convexity facing toward the inside of the sack body 2, and as a result of the convex shape, a cone summit in the corner spot 23*a* is structurally avoidable. Accordingly, even if stress concentration due to air pressure and the like is generated on both of corner spots 23*a*, stress on these areas will be deconcentrated, and accordingly, sack failure or burst of the container 1 can be avoided. It is preferable for the corner spot 23*a* to have usually a shape of circle, polygon having number of angles not less than that of hexagon and resembling circle in shape or ring, and the circle may be round or ellipse. Otherwise, the shape may be semicircle or a shape of tongue as shown in FIG. 4.

Figure 5:
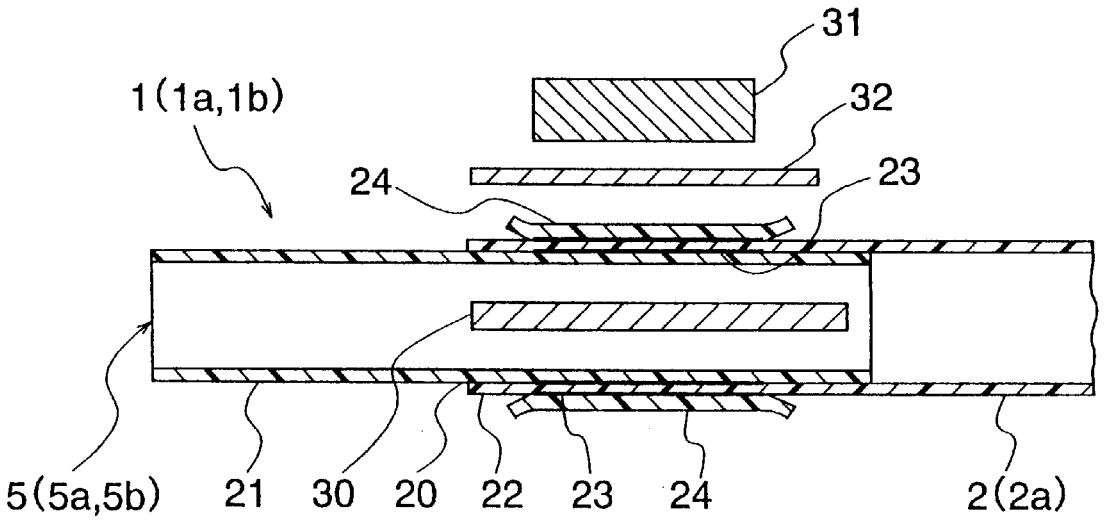
FIG. 5 is a cross-sectional view for explaining a process for mounting a ventilating end on a container.

Referring to FIG. 5, a process for mounting a ventilating end will be set forth in the following. At first, through a plastic sack body 2*a* a line slit 20 is made, and into the slit 20 a cylindrical film 21 of the same material is inserted. Then, in order to avoid melt adhesion of the cylindrical film 21 between its facing insides, a fluorocarbon resin sheet 30 is inserted into the cylindrical film 21. Further, a fluorocarbon resin sheet 32 is provided outside the cylindrical film 21. While maintaining this state, by heat-sealing in line from outside, sack body 2 and cylindrical film 21 are at first melt-bonded along the periphery 22 of a slit 20 to form a sealed line 26 and unify both of them. Secondary, with a circular heat sealer 31 the periphery 22*a* and the cylindrical film 21, positioned at both ends of the slit 20 along its longitudinal direction, are melt-bonded to each other while the fluorocarbon resin sheet 32 is sandwiched. This gives a container having the corner spot 23*a* curved convexity facing toward the inside of the sack body 2.

In this process, the circular heat sealer 31 has a diameter ranging from about 20 to 100 mm, preferably, from 40 to 60 mm, and its temperature ranges from 120 to 300° C., preferably from 200 to 250° C. This heat sealer may have a shape of circle, polygon, ring (doughnut) or the like. In case that the surface of the heat sealer is coated by fluorocarbon resin, adhesion to the film can be avoided, and accordingly, operations become easy.

Figure 6:
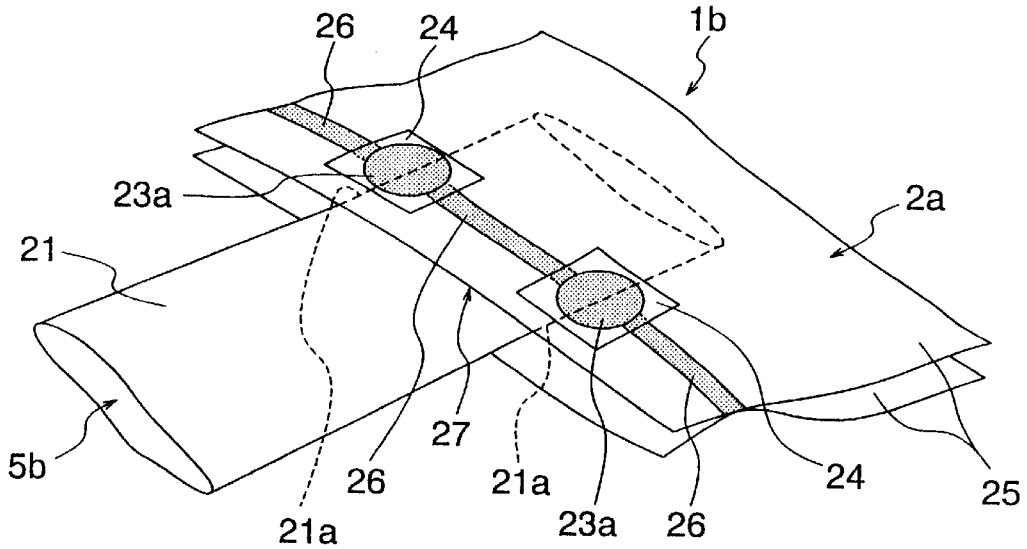
FIGS. 6, 7 are each a perspective view regarding an essential part of a container belonging to other embodiments of the present invention.

FIG. 6 is a perspective view showing other embodiment of the present invention. In this embodiment, film 25 for a sack body 2*a* is folded, a cylindrical film 21 is inserted between the folded film, and heat-sealing is performed near a seam 27 in line. This results in melt-bonding the film 25 and the cylindrical film 21 on a seal line 26 as well as melt-bonding the film 25 mutually between its inner surfaces to form finally a sack body 2*a*.

Accordingly, in this embodiment, the seam 27 corresponds the slit 20 in FIG. 4. Further, in FIG. 6, the bonded portion 23*a* on the seal line 26, i.e., the superposed portion of the sack body 2*a* and the end 21*a* of the cylindrical film 21, corresponds to the corner spot 23*a*, as explained in reference to FIG. 4, and on this spot circular heat-sealing is performed to form a convex curve toward the inside of the sack body 2*a*.

Figure 7:
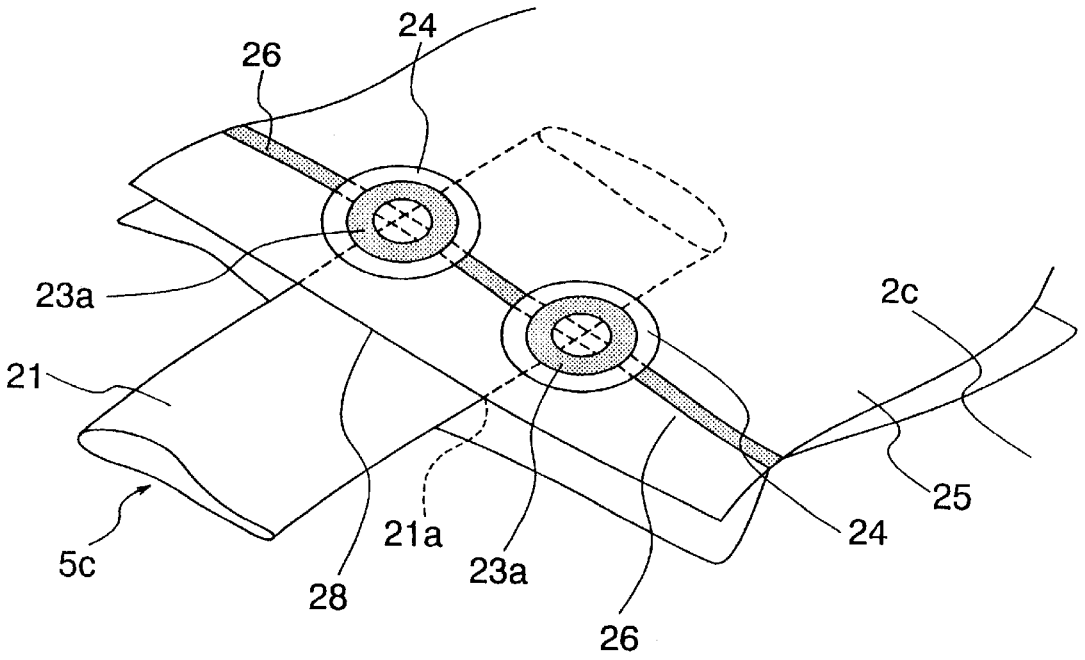

FIG. 7 is a perspective view showing other embodiment of the present invention. In this embodiment, a film 25, which looks like two sheets of film partially, is superposed on each other, a cylindrical film is inserted between the superposed portions of the film, and heat-sealing is performed near the superposed end 28 in line. This results in melt-bonding the film 25 and the cylindrical film 21 on a seal line 26 as well as the film 25 mutually between its inner faces to form a sack body 2*c*. Accordingly, in this embodiment, the superposed end 28 area in which the film 25 is not mutually heat-sealed, i.e., the bonded portion of the film 25 and the cylindrical film 21 corresponds the slit 20 in FIG. 4. Further, as shown in FIG. 7, the bonded portion 23*a* on the seal line 26, i.e., the superposed portion of the sack body 2*c* and the end 21*a* of the cylindrical film 21, corresponds to the corner spot 23*a* as had explained in reference to FIG. 4, and on this spot ringed heat-sealing is performed to form a convex curve toward the inside of the sack body 2*c*.

Figure 8:
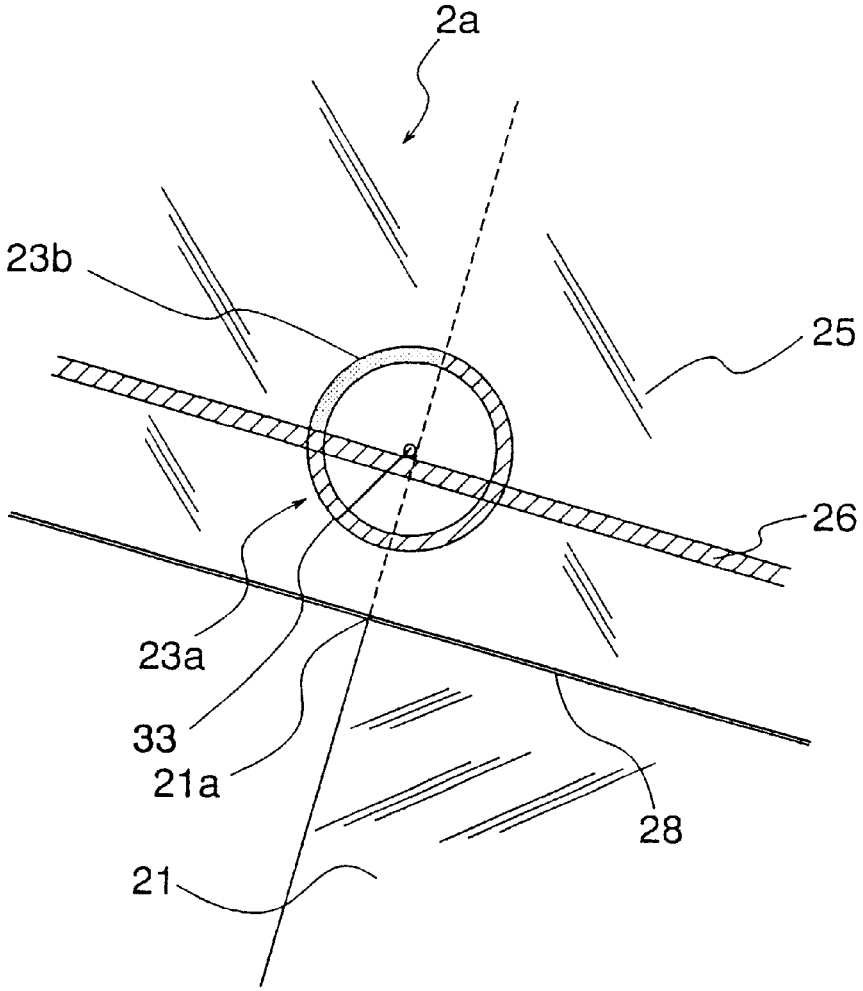
FIG. 8 is a partially enlarged perspective view around a corner spot shown in FIG. 7.

Next, as to the corner spot heat-sealed in the ringed shape as shown in FIG. 7, more detailed explanation will be set forth. FIG. 8 is an enlarged perspective view around the corner spot 23*a*. In the conventional mounting process of a ventilating end, at an intersection ("33" in FIG. 8), of the cylindrical film's end and seal line (which corresponds to a code "26" in FIG. 8) produced by heat-sealing a sack body and a cylindrical film inserted into its slit in line, an acute summit is inevitably formed so that inner stress concentrates on this point, and thereby bursting of container would occur in some cases. In contrast, in the embodiment of the present invention as shown in FIG. 8, by forming a heat-sealed portion 23*a*, of ringed shape involving the aforementioned intersection, in the corner spot, an unbonded portion 23*b* of film 25 and cylindrical film 21 has a convex curve in outline, stress on the corner spot is deconcentrated, thereby the container may be prevented from bursting.

Figure 9:
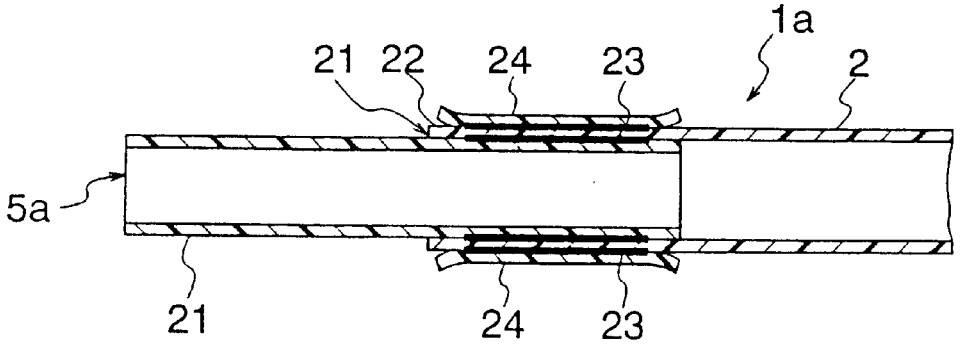
FIG. 9 is a cross-sectional view regarding an essential part of a container belonging to other embodiment of the present invention.

Another embodiment of the present invention is shown in FIG. 9 as a cross-sectional view. In this embodiment, on a corner spot 23*a* of a sack body 2 and a cylindrical film 21, reinforcing films 24 of the same material are bonded in the same shape with that of the corner spot 23*a* in one piece. Namely, during the time of forming the corner spot 23*a*, the reinforcing films 24 are placed and superposed on the same place and heat-sealing is performed on the reinforcing films 24 to form a convex curve toward the inside of the sack body 2, thereby forming the corner spot 23*a* and bonding the reinforcing films 24 can be realized in parallel. In the FIG. 6, two sheets of tetragonal reinforcing film 24 bonded on the corner spot 23 in one piece can be seen. In FIG. 7, two sheets of circular reinforcing film 24 sandwiching front and back film 25 and bonded to the corner spot 23*a* on both side in one piece. In case that the reinforcing film 24 is bonded on the corner spot 23*a* in one piece in this way, strength of the corner spot 23*a* can be increased much more. Other constitutions may be the same as those in the embodiments as had explained above.

EXAMPLE

In order to check the effect of the aforementioned container's constitutions, the embodiments of the present invention, following experiments were performed. Now, the present invention will be explained more in detail on the basis of the experimental results. However, it is to be understood that the invention is not intended to be limited to the specific embodiments

Example 1

From the composition of low-density polyethylene (LDPE, melt flow rate (MFR)=0.5 g/10 min.; ASTM D1238) and ethylene-vinyl acetate copolymer (EVA, vinyl acetate content: 5 wt %) a cylindrical blown or inflation film of 200 μm in thickness was formed. By using this film, there was prepared a container shown in FIG. 1 of a rectangular parallelepiped having length of about 5,900 mm, width of about 2,500 mm and height of about 2,400 mm. On this container feeding end 3 and discharging end 4 were mounted, and further a ventilating end 5 was mounted in the same manner as that explained in reference to FIG. 4.

Next, all the openings except that of the feeding end 3 were shut. To the feeding end 3 a gas blowing nozzle was connected, and further, a blower was connected to the nozzle. A manometer for measuring pressure in the container was mounted. While the blower was actuated to supply air into the container, to the pressure in the container was increased gradually, and the sealing state around the bonded portion 23 of the ventilating end 5 was investigated. The result is reported in Table 1.

Example 2

By using the same film of Example 1, the same container of Example 1 was prepared. The same procedure was repeated except that a ventilating end 5*a* was mounted in the same manner as shown in FIG. 9. As to the resultant container sealing state around the bonded portion 23 of the ventilating end 5*a* was investigated, and the result in Table 1.

Example 3

By using the same film of Example 1, the same container of Example 1 was prepared. The same procedure was repeated except that a ventilating end 5*b* was mounted in the same manner as shown in FIG. 6. As to the resultant container the sealing state around the bonded portion 23 of the ventilating end 5*b* was investigated, and the result is reported in Table 1.

Comparative Example 1

Figure 10:
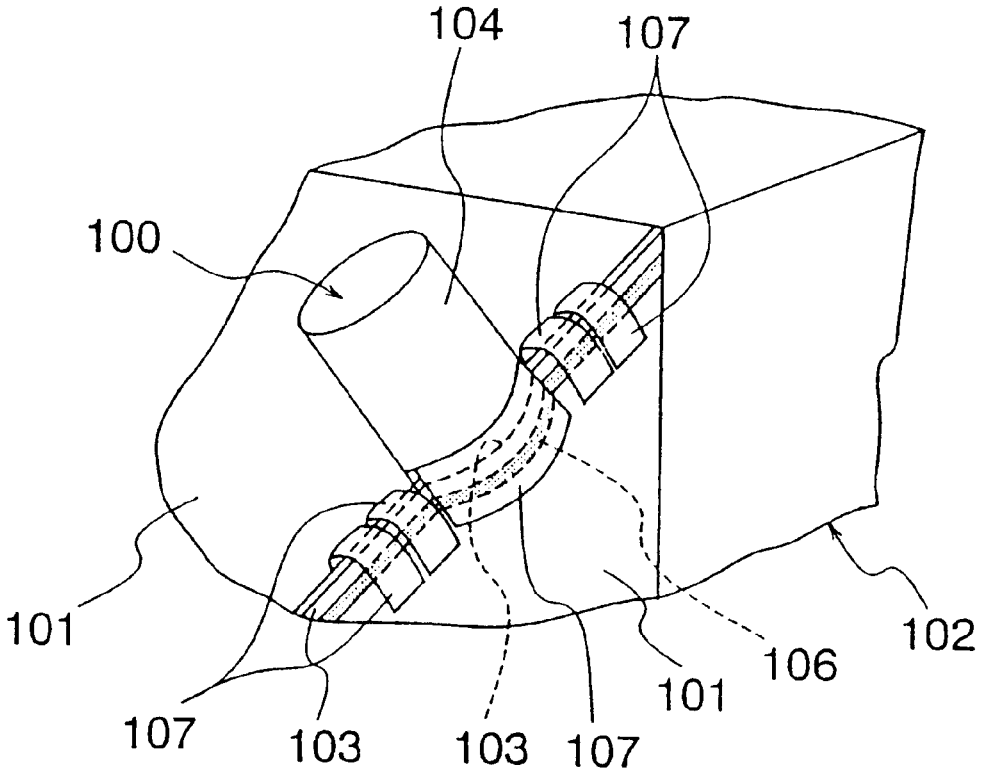
FIG. 10 is a perspective view for explaining a conventional mounting design for a ventilating end on a container.
Figure 11:
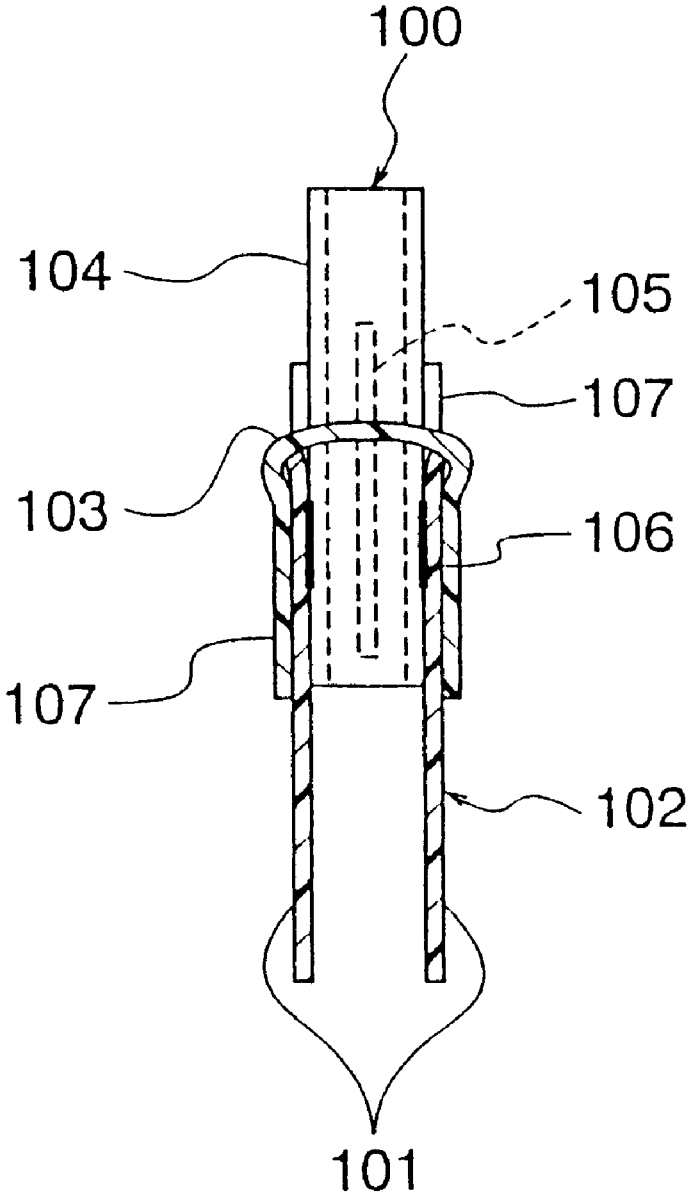
FIG. 11 is its cross-sectional view.

By using the same film of Example 1, the same container of Example 1 was prepared. Then, a ventilating end 100 was mounted in the same manner as shown in FIG. 10, but adhesive sheet 107 as shown in FIG. 10 was not used. As to the container thus obtained in the same way as in Example 1 sealing state around the bonded portion 23 of the ventilating end 5 was investigated while the blower was actuated to supply air into the container, to increase gradually the pressure in the container. The result in Table 1.

The results shown in Table 1 indicate that the containers of Example 1 to 3 have improved pressure-resistive strength as compared with the container of Comparative Example 1. Further, the containers of Example 2 and 3 exhibit better results than that of Example 1. This suggests that the improving effect of the reinforcing film is considerably high.

TABLE 1

| TEST RESULTS | |
|---|---|
| Example 1 | The state of a sack body was observed while pressure was gradually increased and then 300 mmAq was maintained for time. As a result, no change was observed. Even though pressure was further increased up to 500 mmAq, there was no pinhole generated and no change was observed. |
| Example 2 | The state of a sack body was observed while pressure was gradually increased and then 300 mmAq was maintained for a time. As a result, no change was observed. Even though pressure was further increased up to 500 mmAq, there was no pinhole generated and no change was observed. Moreover, there was no symptom of undercut from the bonded portion, and it was turn out that second cut was avoided. |
| Example 3 | Approximately the same result of Example 2 was obtained. Namely, no pinhole generated and no change was observed though pressure was increased up to 300 mmAq, and there was no sympton of undercut from the bonded portion to prove that second cut was inhibited though pressure was increased up to 500 mmAq. |
| Comparative Example 1 | Pressure was gradually increased while the state of a sack body was observed. Generation of pinholes at the position structurally corresponding to a cone summit was started at 100 mmAq. When pressure was further increased up to 200 mmAq, pinholes was grown up to holes of 50 mm in diameter to fail practical value as a sack body. |

INDUSTRIAL APPLICABILITY OF THE INVENTION

According to the present invention, sack body and cylindrical film can be bonded strongly, and this makes it possible to increase pressure-resistive strength of a container. Especially, the corner spot in the bonded portion of the sack body and the cylindrical body does not form acute summit as can be seen in the conventional container of a sack body but forms a convex curve toward the inside of the sack body, thereby pressure applied inside the sack body does not concentrate on the corner spot but can be deconcentrated, and accordingly, pinhole generation of the bonded portion may be avoided to make it possible to enhance pressure-resistive strength as well as to prevent burst of the container.

Further, when a reinforcing film is bonded to the corner spot wherein the sack body and the cylindrical film are bonded to each other in the same shape with that of the corner spot in one piece, stress deconcentrates on the corner spot more surely, and undercut will be saved from the bonded portion, thereby second cut may become avoided. By this application of the reinforcing film, strength of the bonded portion of the sack body and the ventilator may be enhanced much more.

Moreover, in a container of the present invention, in preparing a sack body from a film, a ventilating end can be mounted in parallel, and it is reduced or unnecessary to use a pressure-sensitive tape for reinforcing which has been used conventionally to enhance strength. On this account, effort and cost for preparing can be reduced.

It is further understood by those skilled in the art that the foregoing description is of preferred embodiments of the disclosed container and that various changes and modifications may be made in the invention without departing from the spirit and scope thereof.

What is claimed is:

1. A container comprising a sack body made of plastic film having a slit, said slit having opposed ends and peripheral side edges extending between the opposed ends, and a cylindrical film inserted through said slit, said sack body and said cylindrical film being bonded to each other and united along the periphery of said slit, forming bonded portions, both of the bonded portions, of said slit periphery and said cylindrical film located at both ends of said slit along the longitudinal direction thereof, having a convex curve projecting toward the inside of said sack body.

2. The container as claimed in claim 1, wherein said sack body is heat-sealed to said cylindrical film.

3. The container as claimed in claim 1, wherein said slit comprises a linear cut in said sack body.

4. The container as claimed in claim 1, wherein said sack body is formed by folding a film and sealing the resultant seam, and wherein said slit comprises an unsealed portion of said seam.

5. The container as claimed in claim 1, wherein said slit comprises an unbonded portion formed in preparing said sack body by superposing two sheets of film on each other and bonding the superposed portion.

6. The container as claimed in claim 1, wherein each of said bonded portions located around both ends of said slit along the longitudinal direction thereof, has a shape of circle.

7. The container as claimed in claim 1, wherein each of said bonded portions located around both ends of said slit along the longitudinal direction thereof, has a shape of ring.

8. A container comprising a sack body made of plastic film having a slit, said slit having opposed ends and peripheral side edges extending between the opposing ends, and a cylindrical film inserted through said slit, said sack body and said cylindrical film being bonded to each other and united along the peripheral side edges of said slit forming bonded portions, both of the bonded portions, of said slit peripheral side edges and said cylindrical film located around both ends of said slit along the longitudinal direction thereof, having a convex curve projecting toward the inside of said sack body, and further comprising a reinforcing film having the same shape as said bonded portions and being bonded thereon.

9. A container comprising a sack body having the approximate shape of a rectangular parallelpiped, said sack body comprising at one end thereof a filling opening for introducing material to be stored in said container, a discharge opening for discharging material from said container, and a generally linear slit having opposed ends and peripheral side edges extending between said opposed ends, and a ventilating end comprising a cylindrical film inserted into said sack, through said slit, said cylindrical film and said sack body being bonded to each other, in the vicinity of the peripheral side edges of said slit, forming bonded portions, located around both of the opposed ends of the slit, along the longitudinal direction thereof, said bonded portions encompassing the ends of the slit, having a convex curve projecting toward the inside of said sack body.

* * * * *